US007344215B2

(12) United States Patent
Cutler et al.

(10) Patent No.: US 7,344,215 B2
(45) Date of Patent: Mar. 18, 2008

(54) INKJET CARTRIDGE REFILLING MACHINE AND METHOD

(75) Inventors: Clayton R. Cutler, Columbia, TN (US); Richard Hoehn, Franklin, TN (US); Gary Rajcula, Franklin, TN (US); Terry Rowlison, Murfreesboro, TN (US); Sergio Tonini, Franklin, TN (US); Zlatko Vujic, Nashville, TN (US); Allen Luthy, Franklin, TN (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 328 days.

(21) Appl. No.: 11/236,989

(22) Filed: Sep. 28, 2005

(65) Prior Publication Data

US 2006/0109320 A1 May 25, 2006

Related U.S. Application Data

(60) Provisional application No. 60/613,640, filed on Sep. 28, 2004.

(51) Int. Cl.
*B41J 2/195* (2006.01)
*B41J 2/175* (2006.01)
*B65B 1/04* (2006.01)

(52) U.S. Cl. ..... 347/7; 347/85; 141/2; 141/18

(58) Field of Classification Search ..... 347/7, 347/19, 85; 141/2, 18, 90
See application file for complete search history.

(56) References Cited

U.S. PATENT DOCUMENTS

| | | | | |
|---|---|---|---|---|
| 5,631,681 | A * | 5/1997 | Klaus et al. | 347/85 |
| 5,663,754 | A | 9/1997 | Lorenze, Jr. et al. | |
| 5,704,403 | A * | 1/1998 | Schwenk et al. | 141/18 |
| 5,704,405 | A | 1/1998 | Lisec | |
| 6,332,481 | B1 * | 12/2001 | Shinada et al. | 141/18 |
| 6,729,360 | B2 | 5/2004 | Sesek et al. | |
| 6,945,640 | B2 | 9/2005 | Cheok | |
| 7,089,973 | B2 * | 8/2006 | Nicodem et al. | 141/18 |
| 7,207,667 | B2 * | 4/2007 | Ansier et al. | 347/85 |
| 2004/0046841 | A1 | 3/2004 | Cheok | |
| 2005/0034777 | A1 | 2/2005 | Nicodem et al. | |
| 2006/0017789 | A1 | 1/2006 | Fletcher et al. | |
| 2007/0051421 | A1 | 3/2007 | Sarnoff et al. | |
| 2007/0052740 | A1 | 3/2007 | Guhse et al. | |
| 2007/0052748 | A1 | 3/2007 | Sarnoff et al. | |
| 2007/0052767 | A1 | 3/2007 | Guhse et al. | |

FOREIGN PATENT DOCUMENTS

| | | |
|---|---|---|
| WO | WO 2005/017800 | 2/2005 |
| WO | WO 2005/092626 | 10/2005 |

* cited by examiner

*Primary Examiner*—Anh T. N. Vo

(57) ABSTRACT

The present invention relates to inkjet cartridges, and more specifically, to a machine and process for use in refilling such inkjet cartridges.

23 Claims, 6 Drawing Sheets

INKJET CARTRIDGE REFILLING MACHINE AND METHOD

CROSS-REFERENCE TO RELATED APPLICATIONS

This application claims priority under 35 U.S.C. §119 from U.S. Provisional Application Ser. No. 60/613,640 (filed Sep. 28, 2004), the disclosure of which is incorporated by reference herein for all purposes as if fully set forth.

BACKGROUND OF THE INVENTION

The present invention relates to inkjet ink cartridges and, more specifically, to a machine and method for use in refilling such inkjet ink cartridges.

Inkjet printing is a non-impact printing process in which droplets of ink are deposited on print media, such as paper, to form the desired image. The droplets are ejected from a printhead in response to electrical signals generated by a microprocessor.

With the advent of computers, more people, both in an individual capacity and as business owners, have purchased digital printers including inkjet printers.

Many of these inkjet printers, particularly for the small office/home office ("SOHO") market segment, contain ink cartridges. The ink cartridges can simply be ink tanks containing a supply of ink, which ink tank is connected to a printhead incorporated into the printer assembly, or can be integrated cartridges containing an ink tank and an integrated printhead. The ink tanks of the integrated cartridges usually contain either a sponge or a bladder to contain the ink supply.

Ink cartridges for the SOHO market typically contain up to about 50 ml of ink, albeit most often significantly less than that, and the integrated cartridges can cost as much as $40-50 for a single cartridge.

Some cartridges just contain black ink, while others contain one or a combination of colors (typically cyan, yellow and/or magenta). When the ink in the cartridge is exhausted (including the case where only one of the inks from a tri-color cartridge is depleted), or the cartridge stops functioning properly (for example, due to clogging of the printhead), the user has several options. Traditionally, the user has simply thrown the "spent" cartridge away and purchased an original equipment ("OEM") replacement at a high price. More recently, however, the user has been presented with a number of lower-cost aftermarket alternatives.

The least expensive of these alternatives is a self-refill kit, in which the user is supplied a bottle of ink, some tools (such as a syringe) and instructions on accessing and replenishing the ink supply. The use of these kits, however, tends to create a mess and the results are often far less than adequate in terms of refillability and successful reuse of the refilled cartridge.

As another available alternative, the user can mail the spent cartridge to an industrial entity that will refill the cartridge and mail it back to the user. When the cartridge is mailed in for refill, the process is rather slow and the cartridge can be damaged in the mail during transportation to or handling at the refilling company, rendering the cartridge unsuitable for refilling. The cartridge can also be damaged after it is refilled. In both cases, the user loses both time and money in an unsuitable replacement. The very nature of the mail-in refilling process necessitates days or weeks of combined transit and process time prior to refilling, and the effect of this time on the cartridge is detrimental. The longer a cartridge exists in an empty state, removed from the printer, the less likely it is to be successfully refilled.

Further, most ink jet cartridge refilling companies are industrial facilities that conduct volume refills. These facilities are not suitable for individual customers. The refilling process typically involves many machines that process cartridges in batches. For example, a batch of cartridges may first be processed so that any ink remaining in the cartridges is emptied. Then, that batch is moved to another machine that cleans the inner areas of the cartridges to ensure the removal of all of the ink residue. Then, for example, the batch is moved to another machine that fills all the cartridges. Finally, the batch is moved to another station that checks each cartridge performance for accuracy against the OEM's reference print, which is common in the trade. The finished cartridges are then packaged and held for shipment to vendors per order.

More typically, these industrial refillers supply refilled cartridges in bulk to resellers, such as office supply stores or mail order services, that sell these refilled cartridges under the store or service brand for a discount (typically 20-33% less) as compared to the price of a comparable "new" OEM cartridge.

One disadvantage to the mail order service is that it does take time to process orders and to ship. In addition, with both the mail order services and local store resellers, there is often a higher cartridge failure rate (either total failure or less than advertised print life) as compared to new OEM cartridges, which is typically handled though a return and exchange process, potentially causing additional time, inconvenience and expense for the user.

What is desired, therefore, is a machine that can refill and test individual ink jet cartridges of the most common types, for individual users, while the cartridge to be refilled is still extremely fresh, and while the consumer is present. This will allow the consumer more options for filling the cartridge, minimize incidents of damage to the cartridge after the cartridge is filled because the consumer can maintain control over the cartridge in transit, and reduce the risk of the user obtaining a defective cartridge.

Accordingly, it would be desirable to provide a machine that is suitable for refilling a variety of inkjet cartridges (such as those by different manufacturers) quickly, easily and affordably, with only a minimum of adjustment to the machine's operation, and in other than an industrial setting, such as at a retail location.

SUMMARY OF THE INVENTION

In accordance with one aspect of the present invention, there is provided an ink jet cartridge refilling machine that is capable of processing, refilling and testing a used inkjet ink cartridge of the type containing (a) an ink tank with residual ink and (b) an integrated printhead. The machine, when staffed by an appropriately trained operator (typically a below average retail technician), is suitable for use at a retail location such as a mall or office supply store.

The refilling machine in accordance with the present invention generally comprises a cabinet structure, a circuit test station and print test station, wherein the cabinet structure houses:

a computer, a touch screen display for the computer, a cleaning station, a centrifuge station, a drill station and a filling station.

The computer should be programmed (loaded) with software that provides a below average retail technician operator (with a minimum of training), via the touch screen display, with sufficient information to completely process, refill and test a used cartridge brought to the operator for refilling.

The computer should also be programmed with software that collects information on at least the number and type of cartridges that have been refilled, which information can be readily processed to generate additional information on ink and other supply usage. This supply usage information can advantageously be accessed remotely (via a communication port hooked up, for example, to a telephone line or the internet) for the purpose of reordering supplies to ensure continued operation of the machine. The communication port can also be utilized to obtain diagnostic and other operating information on the machine and its components.

It is preferred that all of the components of the machine are integrated into the same cabinet structure. The cabinet structure itself may be multipiece, with the various pieces connected to one another such that the refilling machine can be placed in a relatively small floor space. The machine preferably has a relatively small footprint (and preferably no greater than 4 feet wide by 3 feet deep) that makes it especially suitable for operation in a retail store environment, where space can be limited. When placed in a retail environment, it is preferred that the machine and its components are oriented so that the customer does not have ready access to any of the operational components of the machine.

In accordance with another aspect of the present invention, there is provided a process for refilling a used inkjet ink cartridge comprising a tank portion and an integrated printhead, wherein the tank portion comprises either a sponge or a bladder containing residual ink, comprising the steps of (1) providing an inkjet cartridge refilling machine as generally mentioned above and described in further detail below;

(2) providing an operator for operating the inkjet cartridge refilling machine;

(3) receiving an inkjet cartridge to be refilled from a customer;

(4) having the operator initiate the software to process, refill and test the cartridge;

(5) having the operator receive a first instruction via the touch screen display requesting information to identify the type of cartridge to be refilled;

(6) having the operator enter information into the computer via the touch screen display about the type of cartridge to be refilled;

(7) upon identifying the type of cartridge to be refilled, having the operator receive a second instruction via the touch screen display about testing the cartridge for suitability for refilling;

(8) having the operator test the cartridge for suitability for refilling in accordance with the second instruction;

(9) having the operator receive a third instruction via the touch screen display about removing residual ink from the cartridge via a centrifuge in the centrifuge station;

(10) having the operator remove residual ink from the cartridge in accordance with the third instruction;

(11)(a) in the event that the ink tank contains a sponge, (i) having the operator receive a fourth instruction via the touch screen display about drilling one or more access holes in the tank portion of the cartridge, then (ii) having the operator drill one or more access holes into the tank portion of the cartridge in accordance with the fourth instruction;

(11)(b) in the event that the ink tank contains a bladder, having the operator receive a fourth instruction via the touch screen display to proceed to the cleaning step;

(12) having the operator receive a fifth instruction via the touch screen display about cleaning the printhead on the cartridge in the cleaning station;

(13) having the operator clean the printhead in accordance with the fifth instruction;

(14) having the operator receive a sixth instruction via the touch screen display about refilling the tank portion of the cartridge with replacement ink;

(15) having the operator refill the tank portion of the cartridge with replacement ink in accordance with the sixth instruction;

(16) having the operator receive a seventh instruction via the touch screen display about testing the refilled cartridge for print functionality;

(17) having the operator test the refilled cartridge for print functionality in accordance with the seventh instruction; and (18)(a) if the cartridge passes the test for print functionality, having the operator relabel the refilled cartridge, and return the relabeled cartridge to the customer; or (18)(b) if the cartridge does not pass the test for print functionality, having the operator dispose of the refilled cartridge.

It should be noted that the present invention is not limited by the type or even color of replacement ink actually put into the cartridge; however, it is preferable that the replacement ink be as close a match as possible to the original ink (in terms of color and other physical properties, as well as print performance) so that the customer can simply use the refilled cartridge as a drop-in replacement as if the cartridge was new.

These and other features and advantages of the present invention will be more readily understood by those of ordinary skill in the art from a reading of the following detailed description. It is to be appreciated that certain features of the invention which are, for clarity, described above and below in the context of separate embodiments, may also be provided in combination in a single embodiment. Conversely, various features of the invention that are, for brevity, described in the context of a single embodiment, may also be provided separately or in any subcombination. In addition, references in the singular may also include the plural (for example, "a" and "an" may refer to one, or one or more) unless the context specifically states otherwise. Further, reference to values stated in ranges include each and every value within that range.

DETAILED DESCRIPTION OF THE PREFERRED EMBODIMENTS

Figure 1:
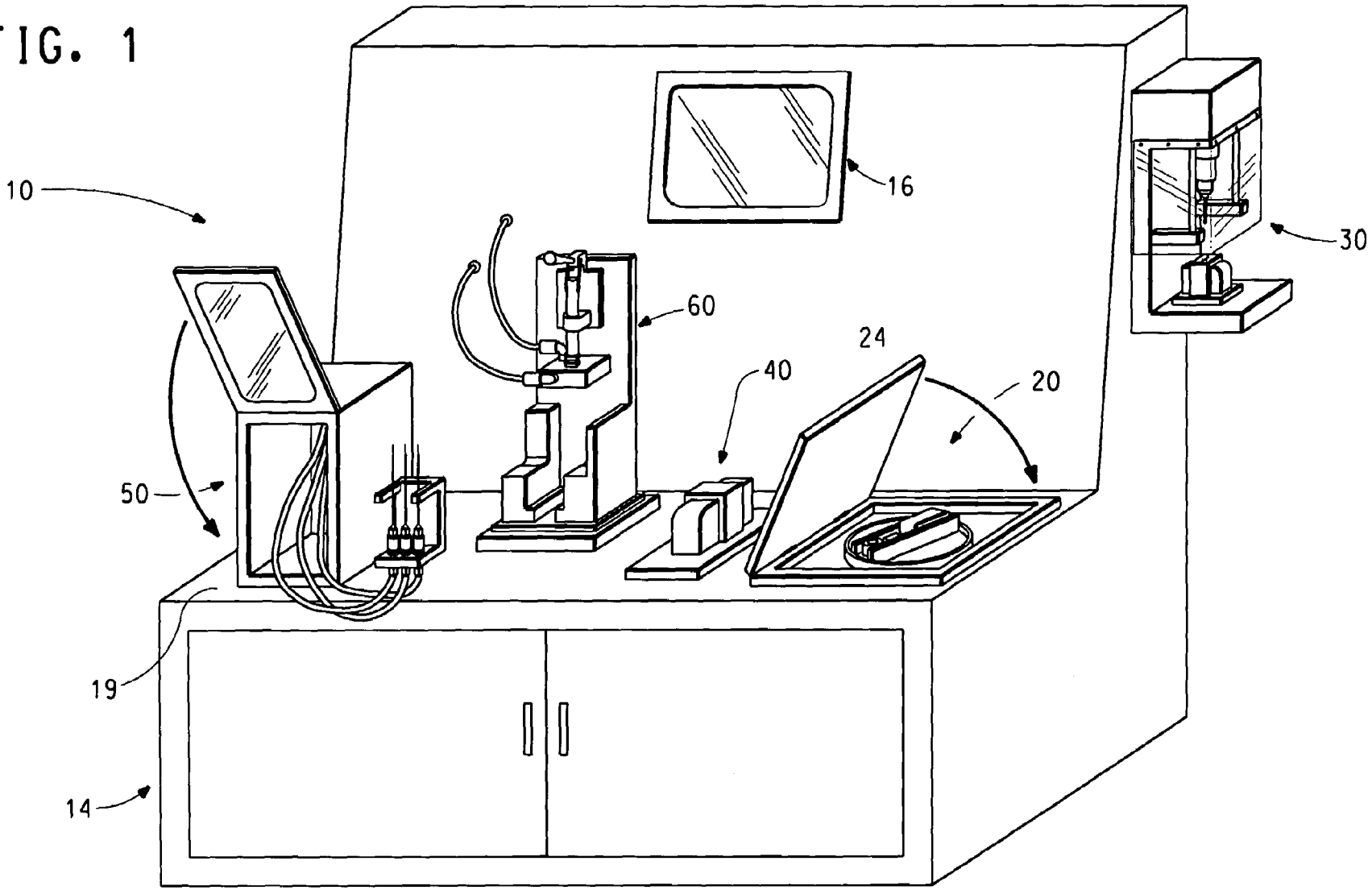
FIG. 1 shows an embodiment of an inkjet cartridge refilling machine 10 in accordance with the present invention.

Referring now to FIG. 1, the integrated inkjet cartridge refilling machine 10 comprises a cabinet 14 that houses a computer (not depicted), a touch screen display 16 for the computer, a centrifuge station 20, a drill station 30, a cleaning station 40 and a filling station.

In general, the computer controls the operation of the refilling machine via software loaded onto the computer, and in conjunction with input received from the operator via the touch screen display; the cleaning station is for cleaning the integrated printhead of the cartridge; the centrifuge station is for removing at least a substantial portion of the residual ink from the ink tank of the cartridge; the drill station is for drilling one or more access holes to the ink tank of the cartridge (where required); and the filling station is for filling replacement ink into the ink tank of the cartridge.

In the preferred embodiment as depicted in FIG. 1, the filling station includes both a vacuum filling device 50 and a pressure filling device 60, as discussed in further detail below. The presence of both devices 50 and 60 provides the refilling machine 10 with the capability to process the two most common types of cartridges—those with a sponge in the ink tank (using vacuum filling device 50), and those with a bladder in the ink tank (using pressure filling device 60).

The machine 10 further includes a circuit test station (not depicted) fortesting the cartridge electronics prior and/or subsequent to refilling, and a print test station (not depicted) for testing the print functionality of the cartridge subsequent to refilling. The circuit and print test stations may be separate from (not an integrated part of) machine 10, but are preferably part of an integrated assembly and are housed in cabinet 14.

Cabinet 14 provides a suitable housing for the touch screen display 16, and further houses the centrifuge station 20, the drill station 30, the cleaning station 40 and the filling station, as well as all associated valves, pumps, tubing, and computer and electronic process control systems in connection therewith (not depicted but as described in further detail below). The cabinet 14 may also contain any other items that the operator desires to store, or that is convenient for the operation of machine 10, such as counterweights for use with centrifuge station 20, a compressor for use with cleaning station 40 and the filling station, and containers of replacement ink.

The computer can be any type of workstation. Touch screen display 16 is preferably a color touch screen, and is driven by software loaded into the computer that is adapted for providing the operator with step-by-step instructions for each cartridge type selected for refilling. Specifically, the software should be designed to provide sufficient information and instruction for the below average retail technician (operator) so that such operator, with minimal advanced training, can operate the machine and process under normal operating solely via instructions provided from and input provided to touch screen display 16.

In a retail environment, a customer will bring in a cartridge to be refilled into the retail location, and provide that cartridge to a retail associate. The retail associate can be the operator or a co-worker of the operator but, for the purposes of this description, will be the operator.

In operation of the refill machine in accordance with the present invention, the operator first checks the touch screen 16 to ensure that the software is at the beginning of the fill cycle instructions. If not, the operator should reinitialize the fill cycle instructions.

The first set of instructions provided by the software to the operator will relate to cartridge identification. For example, the initial screen displayed typically will instruct the operator to identify the type of cartridge, such as either an HP or a LEXMARK cartridge. After the operator enters this information, the touch screen display 16 should instruct the operator to identify the cartridge as either a color ink cartridge or a black ink cartridge. Then, the touch screen display 16 should instruct the operator to identify the cartridge by its model number. Once a cartridge identity is displayed, the operator is then typically asked to confirm the cartridge identification.

The operator will normally be able to identify the cartridge by identification markings on the cartridge or labeling on the cartridge. By inputting the particular cartridge type into the system via the touch screen display 16, the computer automatically adjusts all process parameters and operator instructions for such specific cartridge.

Once the cartridge is identified, the touch screen 16 then displays information to assist the operator in conducting a visual inspection of the cartridge to see if any damage can be readily detected. For example, the touch screen 16 can ask the operator to check for a mound of dried ink on the printhead, sticky tape on the cartridge, cracked cartridge housing, damaged copper circuitry and/or ink contamination. The operator answers each segment appropriately.

If for example, the operator indicates that there is ink contamination on the exterior of the cartridge, then the operator can be instructed to gently wipe the cartridge exterior with a wet paper towel. The operator must decide whether to abort or continue with the fill process based on whether or not the cartridge can be appropriately cleaned.

If the operator indicates that the copper circuitry is damaged, then the operator is informed that the cartridge will most likely fail. The operator may still proceed to clean the circuitry with a moistened towel, complete the filling process and then see if the cartridge operates properly, knowing that there is a possibility that it will not perform satisfactorily.

If the operator indicates that the cartridge housing is cracked, then the operator is informed that the cartridge cannot be re-filled with a defective housing and it is recommended that the customer purchase a replacement cartridge.

If the operator indicates that there is sticky tape on the cartridge or nozzles, the operator can try to clean the cartridge with a moistened towel but is warned that the probability of cartridge failure is high. Then, the operator must decide whether to abort or continue with the fill process.

If there is a mound of dry ink on the cartridge, the operator is instructed to moisten a paper towel and dab the printhead to moisten the dry ink, then wipe the printhead until it is ink-free.

After the visual inspection is completed, the operator checks the electronic circuitry of the cartridge by inserting the cartridge into a circuit test station (electrical tester), such as the SmartPrinter or other similar testers, which are sold by FAES USA, Inc., and which are commercially available, and preferably housed in cabinet 14.

In the event that the cartridge fails the basic functionality test, the cartridge can either be returned to the customer as unprocessable, or can simply be disposed of.

Assuming that the cartridge passes the initial visual inspection and electronic circuitry test, the touch screen display 16 will so indicate and provide instructions to the operator on further cartridge processing.

A preferred next step is to remove at least a portion of residual ink in the cartridge utilizing the centrifuge station 20. Preferably, as much as reasonably possible of the old ink in the cartridge is extracted. In one preferred embodiment, as discussed below, the operation of machine 10 is designed to insert a predetermined amount of ink into each cartridge so, in such embodiment, it will be important that substantially all of the unused ink be removed from the cartridge. If some of the "old" ink remains in the cartridge, then the new ink could fill past the desired stop point and possibly overflow, potentially causing damage to the cartridge and/or the machine. The centrifuge 22 contained in centrifuge station 20 is preferably housed below the work surface 19 of cabinet 14, and is universal; that is, it can be used with almost any type of cartridge. A variety of counterweights are also provided (that can be housed in cabinet 14) that must be properly selected and inserted into the centrifuge to ensure proper operation.

The centrifuge station 20 also preferably comprises a hinged door 24, which opens to allow the operator to insert a cartridge and any required counterweights into the centrifuge.

Figure 2:
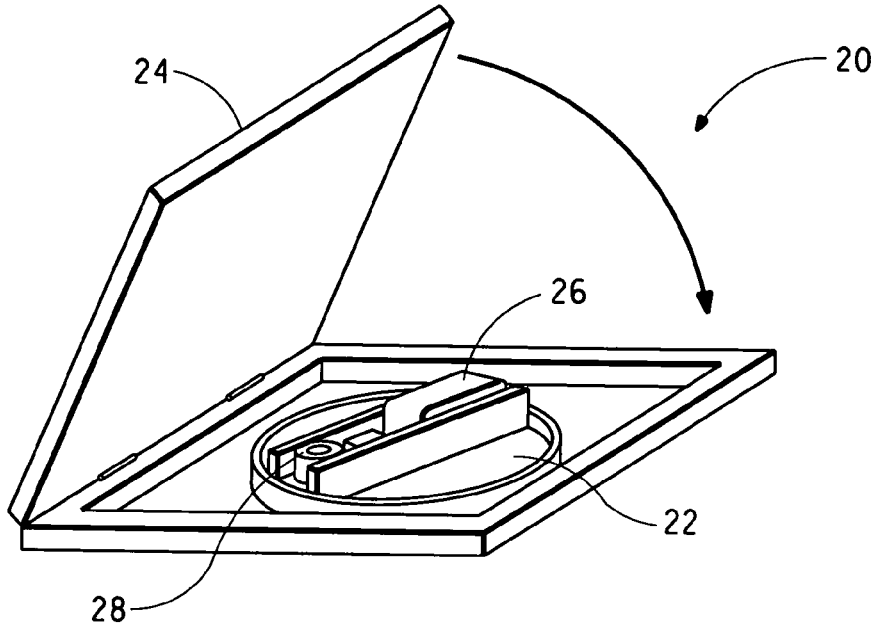
FIG. 2 shows an embodiment of centrifuge station 20.

In a preferred embodiment, the touch screen display 16 then instructs the operator to insert the cartridge into the centrifuge 22 of the centrifuge station 20, and it tells the operator which counterweight to use to balance the centrifuge. Preferably, the counterweights are color-coded to minimize operator error. The particular counterweight used is determined by the cartridge type. As depicted in FIG. 2, the operator opens the centrifuge door 24, places the cartridge 26 in its proper location and adds the counterweight 28. The operator then closes the centrifuge door 24.

When the instructions on the touch screen display 16 instruct the operator to start the centrifuge 20, the operator presses a "start" button on the touch screen display 16. The software should contain instructions to prevent centrifuge 22 from starting while the hinged door 24 is open and, after centrifuge 22 starts, should automatically cause hinged door 24 to lock in the down position for safety reasons. After the centrifuge cycle is completed and centrifuge 22 stops, the hinged door 24 should automatically unlock when it is safe for the operator to reach inside and remove cartridge 26 and counterweight 28. Counterweight 28 can then be stored in its appropriate place in cabinet 14, and the operator should close centrifuge door 24 once the centrifuge cycle is complete.

In a preferred embodiment, once the centrifuge cycle is completed, the operator is instructed in one of two ways depending on the cartridge type.

If the cartridge is of a type in which the ink tank contains a sponge, the operator will be instructed to move the cartridge from the centrifuge station 20 to the drill station 30 to drill one or more access holes in the top of the cartridge, which allows access to the ink tank portion of the cartridge without removing the top of the cartridge.

Figure 3:
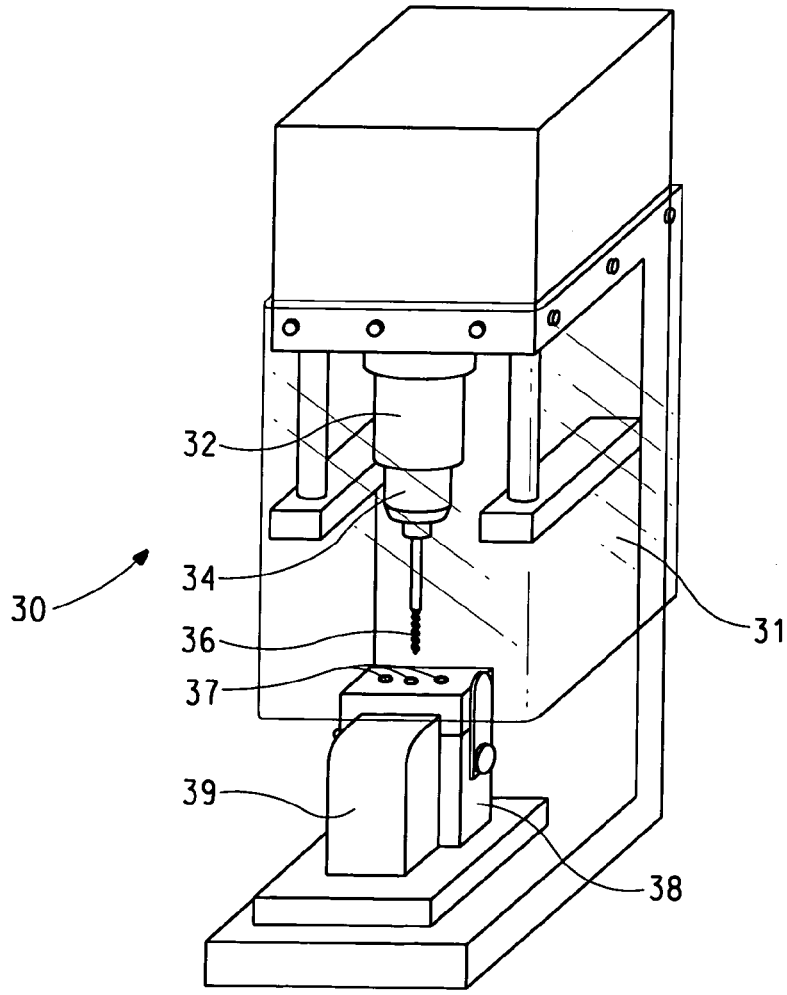
FIG. 3 shows an embodiment of drill station 30.

The drill station 30 is preferably comprised of a universal platform (drill assembly 32). The drill station 30 utilizes one of several specific cartridge holding fixtures designed to safely hold the cartridge while the operator drills holes, a precision drill 34 for housing at least one drill bit 36 (and as many as three drill bits) so that the desired number of holes can be drilled into the top of the cartridge. One such cartridge holding fixture 38 is shown in FIG. 3, which is designed for drilling three holes in cartridge 39. The exact number of holes to be drilled, the corresponding number of drill bits necessary, and the exact location of the holes to be drilled, is determined by the type of cartridge to be filled, and will be indicated on the touch screen display 16. Further, the drill station 30 may comprise a lever (not depicted) for raising and lowering the drill assembly 32 relative to the cartridge 39, and for limiting the depth of each drilled hole to a predetermined amount. Drill station 30 should also include a transparent shield 31 around the cartridge and drilling area so as to protect the operator from debris from the drilling process. The drill 34 in drill assembly 32 is typically an electric drill that is electrically connected to the machine so that the operator can activate a switch (not depicted) on the cabinet 14 surface and start the drilling process. Having a separate operating switch on cabinet 14 for drill assembly 32, as opposed to on/off control via the computer and software, is preferred for safety reasons.

At drill station 30, the operator places the cartridge 39 into the appropriate cartridge holding fixture 38, then into drill assembly 32 to drill the appropriate number of access holes into the top of the cartridge. As depicted in FIG. 3, the operator is drills three holes through the drill positioning holes 37 in cartridge holding fixture 38.

After the holes have been drilled, the operator is then instructed by the touch screen display 16 to remove the cartridge from drill station 30. The cartridge 36, however, can remain in holding fixture 38 for the cleaning step, as discussed below.

When the drill step has been completed, the operator is instructed to move on to cleaning station 40.

If the cartridge is of a type in which the ink tank contains a bladder, the operator will be instructed to move the cartridge from the centrifuge station 20 directly to cleaning station 40, bypassing drill station 30.

Cleaning station 40 is utilized to clean the printhead area of the cartridge. The operator is directed to load the cartridge into a holding fixture (if the cartridge was removed from the holding fixture in the drilling step), which is typically the same holding fixture as used in the operation of the drill station, then directed to position the holding fixture into the cleaning station oriented so that multiple nozzles positioned about the printhead area satisfactorily clean the printhead area of the cartridge. The holding fixture is designed to orient the cartridge printhead at the optimum location for maximum effectiveness during cleaning. It should be understood that any number of nozzles and positions could be utilized so long as the printhead area of the cartridge is adequately cleaned.

Figure 4:
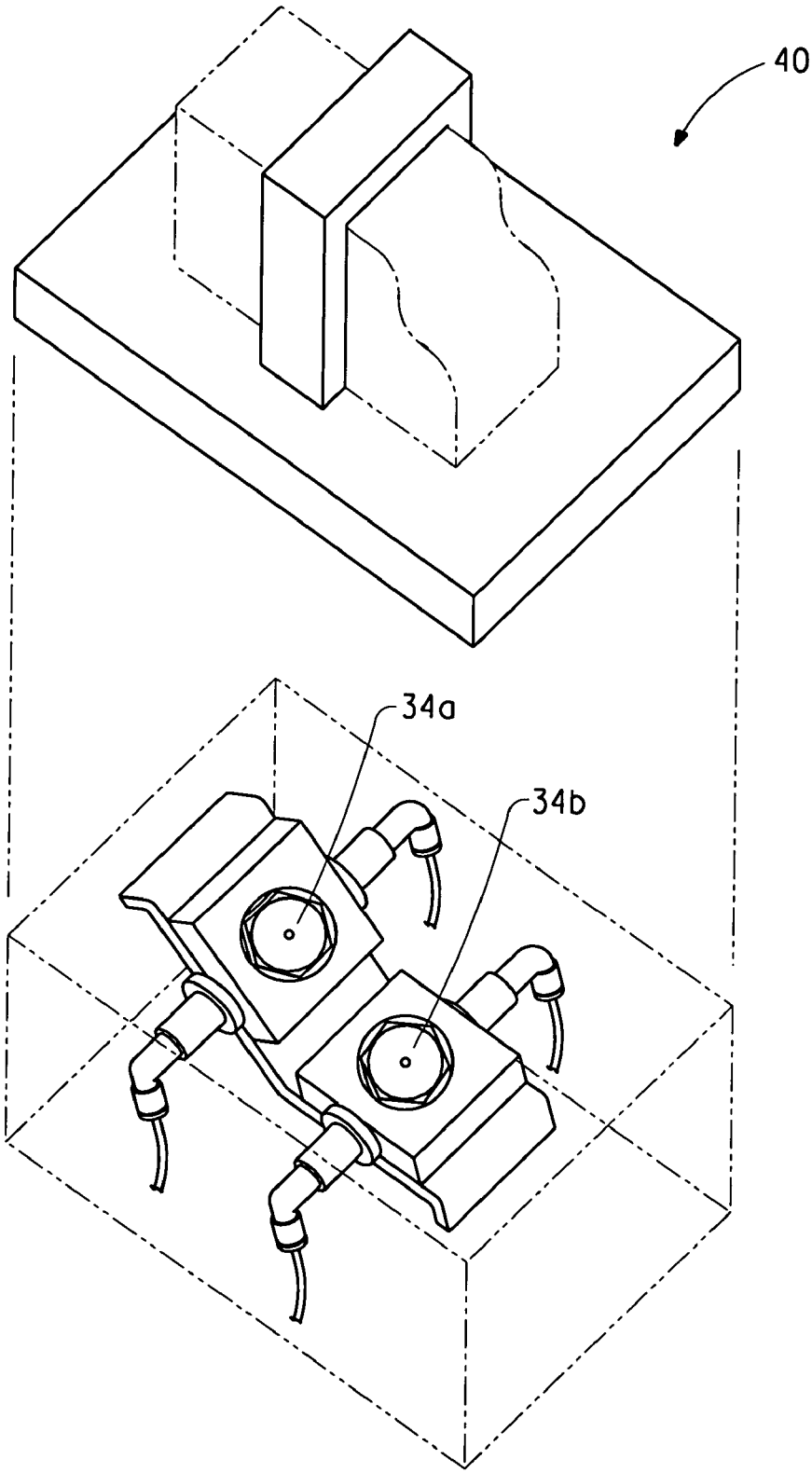
FIG. 4 shows an embodiment of cleaning station 40.

In a more preferred embodiment as depicted in FIG. 4, the cleaning station 30 contains two built-in nozzles 34*a* and 34*b* that are housed below the work surface 19 of the cabinet 14. One nozzle 34*a* is pointed at the bottom of the cartridge at about 45 degrees from horizontal, and the second nozzle 34*b* is pointed directly at the bottom of the cartridge and sprays in the same plane as the bottom of the nozzle. Both nozzles use atomized water molecules to gently spray away ink residue on and inside the cartridge printhead. Both of the nozzles are electrically connected to each other and to a switch (not depicted) that is activated by the computer control when so instructed by the operator by input via touch screen display 16.

In an alternative embodiment, one could position the cartridge in a universal location relative to a predetermined number of nozzles. The nozzles would, as described above, use atomized water to clean the print head area.

Once the cleaning process is indicated to be complete, touch screen display 16 provides instructions to the operator as to the appropriate fill device and instructions for filling the cartridge.

As indicated above, the filling station preferably comprises of two different types of devices for filling the ink jet cartridges.

Figure 5:
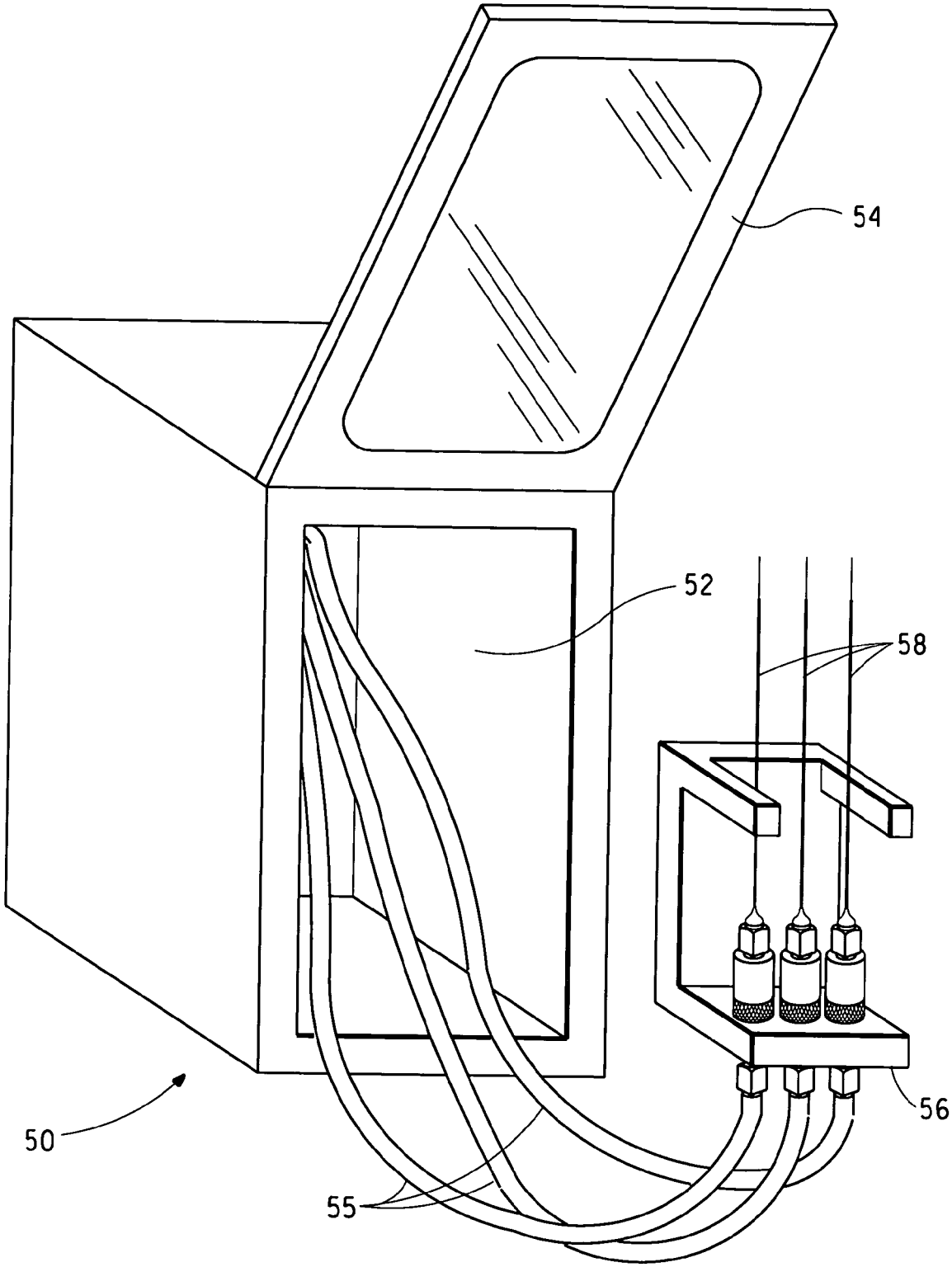
FIG. 5 shows an embodiment of the vacuum filling chamber 50 of the filling station.

One device (vacuum filling device 50), as depicted in FIG. 5, is designed for use with cartridges containing a sponge in the ink tank. Vacuum filling device 50 contains a chamber 52 including a hinged cover 54 which, when closed, allows the operator to utilize chamber 52 for negative air pressure cartridge filling. During filling, ink is metered from storage containers (not depicted) housed in cabinet 14 to the cartridge via fill lines 55 and a fill fixture. A variety of fill fixtures can be utilized, such as fixture 56 in FIG. 5, each including needles 58 of specific diameter, length and position designed allow the delivery of ink to specific cartridge types. For example, a simple black ink cartridge like the HP27 (Hewlett Packard Company) may need one needle, while a tri-color cartridge will need several needles, one for each color to be added to the cartridge.

The individual fill fixtures are designed such that, when the needles are inserted into the correspondingly matched cartridge, the filling occurs in the ink tank of the cartridge as close to the integrated printhead as possible. The negative air pressure (vacuum) in chamber 52 potentially helps draw the replacement ink to the integrated printhead, thereby removing any air or other potential blockage between the ink supply and the integrated printhead.

Touch screen display 16 identifies to the operator the suitable fill fixture to use based on the specific cartridge, then instructs the operator to connect the fill fixture to the appropriate fill lines 55 in chamber 52, and insert the filling fixture needles 58 into a waste drain (not depicted) which can conveniently be located between vacuum filling device 50 and pressure filing device 60. The operator should ensure at this point that everything is properly connected.

Touch screen display 16 then informs the operator that, when the filling process is started, the machine will prime the fill fixture by purging ink through the fill lines and filling fixture and into the waste drain. While the machine is purging ink, the operator is instructed to wait. The purging removes previously used ink, water and air from the filling fixture and fills lines to help ensure that only replacement ink is fed into the cartridge ink tank.

When the purging is complete, the operator is instructed to insert the cartridge into a holding clip (such as the holding fixture utilized in the drilling and cleaning steps), then the operator is instructed to insert the needles into the access holes previously drilled into the cartridge.

The operator is then instructed to place the cartridge into the chamber 52, with the holding clip and filling fixture on the cartridge. Next, the operator is instructed to dose hinged cover 54 of enclosure 52 and ensure that the cartridge is properly positioned. When everything is in order, the filling may begin. When the operator is ready to proceed, the operator presses a start button on the touch screen display 16.

Once the filling has started, touch screen display 16 shows the stages of filling as they are completed and the time remaining to fill the cartridge. When filling is complete, the operator is instructed to open hinged cover 54 and remove the cartridge from enclosure 52. Then, the operator is instructed to remove the cartridge from the filling fixture and place the filling fixture needles into the waste drain, after which they are purged with water, while the operator continues with hand cleaning and print testing the cartridge.

Figure 6:
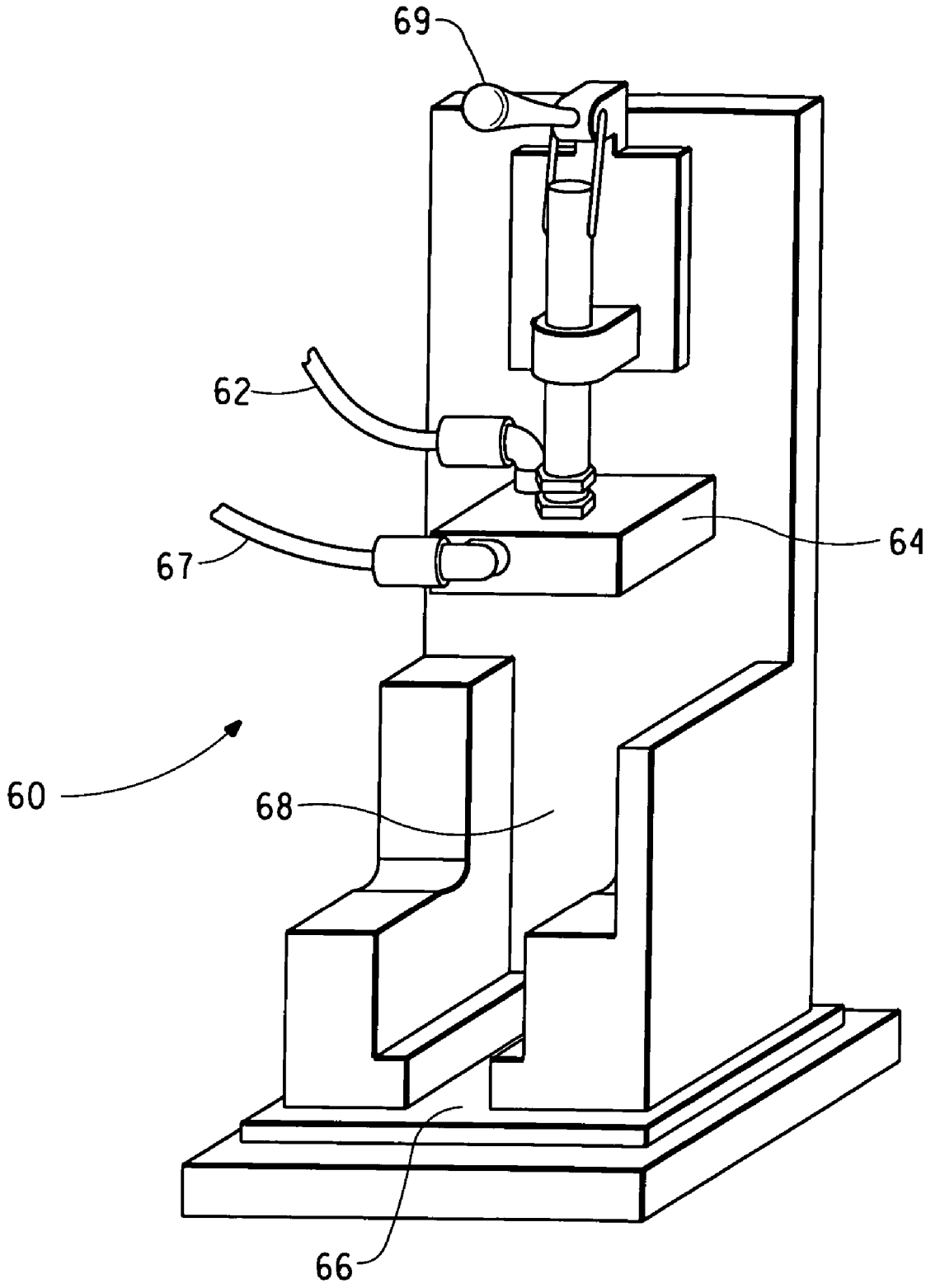
FIG. 6 shows an embodiment of the pressure filling device 60 of the filling station.
Figure 7:
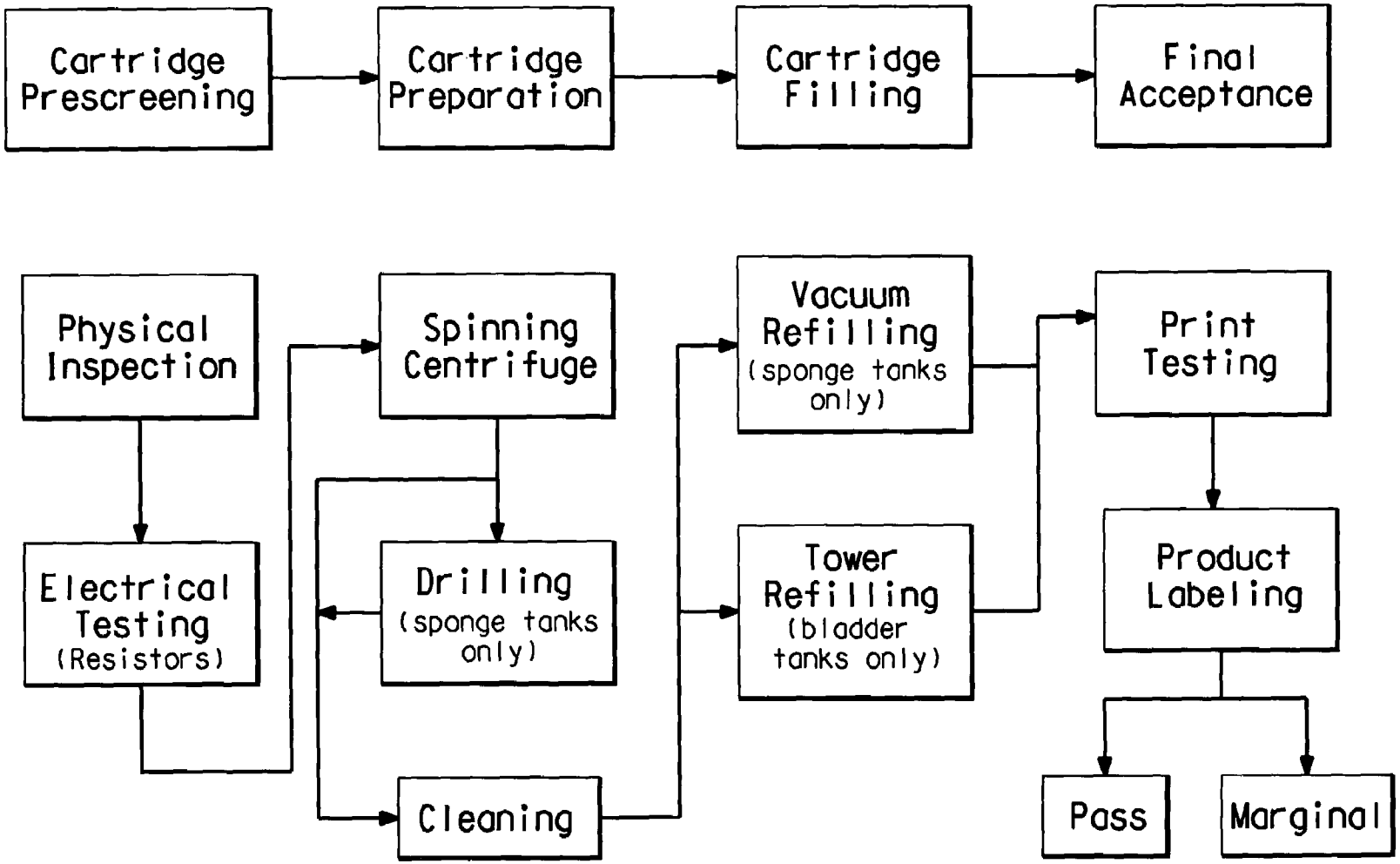
FIG. 7 shows a general and specific process flow diagram of an embodiment of the refilling process in accordance with the present invention.

Other cartridges, such as the HP51626 (Hewlett Packard Company) containing a bladder in the ink tank, cannot be filled by the aforementioned vacuum filling device 50 and must, instead, be filled by the pressure filling device 60 as depicted in FIG. 6. Pressure filling device 60 works by initially applying a negative pressure through the integrated printhead of the cartridge (or another existing fill hole to the bladder) to at least partially deflate the bladder in the ink tank (such as via vacuum line 67), delivering ink through the integrated printhead of the cartridge (or other existing fill hole) into the bladder at greater than atmospheric pressure, followed by the application of a negative pressure to the integrated printhead to achieve a leak-free cartridge.

In the operation of pressure filling device 60, the operator starts the filling process by pressing a start button on the touch screen display 16, which causes the machine to prime the pressure filling device 60 by purging ink through the fill line 62 and fill head 64 into a waste drain (not depicted) located in the bottom plate 66. Once the purge is complete, the operator is instructed to place the cartridge in the holding area 68 with the integrated printhead oriented up toward fill head 64, then to lower fill head 64 via lever 69 to create a seal between the integrated printhead and fill head 64. The bottom surface of fill head 64 is equipped with a pliable surface (not depicted) to help ensure the seal.

Once the operator confirms that the cartridge is in place, the filling process starts and the touch screen display 16 shows the stages of filling as they are completed and the time remaining to fill the cartridge. When filling is complete, the operator is instructed to lift lever 69 and remove the cartridge from holding area 68. Once completed, the fill line 62 and fill head 64 are purged with water, while the operator continues with hand cleaning and print testing the cartridge.

Once the filling is complete, print testing of the cartridge can be done in any convenient manner. Typically, the cartridge is placed in a device that is in electrical contact with the electronics of the cartridge, and electrical signals are applied that cause the cartridge to print predetermined lines and/or shapes to confirm functionality of the individual nozzles on the printhead. Such devices are generally commercially available. It should be noted that a successful refilling does not require 100% functionality (jetting) of all nozzles; rather, it only requires a print quality of a predetermined level considered suitable for the customer.

To wrap up the process, assuming a satisfactory print test, the operator is instructed to appropriately label the refilled cartridge, clean the work surface 19 and reset the touch screen display 16 so that it is ready for the next cartridge. The refilled cartridge can at this point be returned to the customer.

In the event that the cartridge does not pass the print test, the operator will be instructed to so advise the customer, and preferably dispose of the unsuitable cartridge.

Advantageously, the machine 10 and process of the present invention can complete the fill cycle in as little as about 8 minutes, so that the customer can conveniently wait during the processing.

The machine of the present invention is ideal for retail operations because, of its integrated nature, it can be constructed to have a small footprint (preferably no greater than approximately 4'×3'). It is also ideal for the retail sector because it has the capability to refill all the popular inkjet cartridges, such as those made by HP and LEXMARK. Further, the present invention is advantageous because the cartridges can be filled with precise ink volume control and returned to atmospheric pressure without additional operator input.

It should be understood that the foregoing is illustrative and not limiting and that obvious modifications may be made by those skilled in the art without departing from the spirit of the invention. For example, the touch screen instructions described above describe the operation of the machine 10 for filling an acceptable cartridge. If the cartridge was damaged, then obviously the operator input would be different, resulting in different touch screen instructions, such as "abort."

The invention claimed is:

1. An inkjet cartridge refilling machine for refilling a used inkjet ink cartridge, the used inkjet ink cartridge comprising (a) an ink tank containing residual ink and (b) an integrated printhead, wherein the machine comprises a cabinet structure, a circuit test station for testing electronic circuitry of the printhead, and a print test station for testing print functionality of the cartridge subsequent to refilling, wherein the cabinet structure houses:

a computer, a touch screen display for the computer for providing an instruction to and receiving information from an operator of the machine;

a cleaning station for cleaning the integrated printhead of the cartridge, a centrifuge station for removing at least a substantial portion of the residual ink from the ink tank of the cartridge, a drill station for drilling one or more access holes to the ink tank of the cartridge; and a filling station for filling replacement ink into the ink tank of the cartridge.

2. The machine of claim 1, wherein the computer is programmed with a software that provides a below average retail technician operator with sufficient information to process the cartridge through the circuit test station, centrifuge station, drill station, cleaning station, filling station and print test station.

3. The machine of claim 1, wherein the computer is programmed with software that collects information on at least the number and type of cartridges that have been refilled.

4. The machine of claim 1, wherein the cabinet structure further houses the circuit test station and the print test station.

5. The machine of claim 1, wherein the cabinet structure further houses a communication port for allowing remote access to the computer.

6. The machine of claim 1, wherein the cleaning station comprises one or more nozzles oriented to be directed at the integrated printhead of the cartridge when the cartridge is in the cleaning station.

7. The machine of claim 1, wherein the centrifuge station comprises a centrifuge and a lid for covering the centrifuge, and the machine further comprises counterweights for use in the centrifuge.

8. The machine of claim 1, wherein the drill station comprises a drill, and the machine further comprises a holding fixture for holding the cartridge and defining a location of holes to be drilled in the cartridge.

9. The machine of claim 1, wherein the filling station comprises a vacuum filling device.

10. The machine of claim 1, wherein the filling station comprises a pressure filling device.

11. The machine of claim 1, wherein the filling station comprises both a vacuum filling device and a pressure filling device.

12. The machine of claim 1, having a footprint of no greater than four feet wide by three feet deep.

13. The machine of claim 1, wherein the cabinet further houses containers of replacement ink.

14. A process for refilling an inkjet ink cartridge comprising a tank portion and an integrated printhead, wherein the tank portion comprises either a sponge or a bladder containing residual ink, comprising the steps of:

(1) providing an inkjet cartridge refilling machine comprising a cabinet structure, a circuit test station for testing electronic circuitry of the printhead, and a print test station for testing print functionality of the cartridge subsequent to refilling, wherein the cabinet structure houses:

a computer, a touch screen display for the computer for providing an instruction to and receiving information from an operator of the machine;

a cleaning station for cleaning the integrated printhead of the cartridge, a centrifuge station for removing at least a substantial portion of the residual ink from the ink tank of the cartridge, a drill station for drilling one or more access holes to the ink tank of the cartridge; and a filling station for filling replacement ink into the ink tank of the cartridge, wherein the computer is programmed with a software that provides a below average retail technician operator with sufficient information to process, refill and test a cartridge through the circuit test station, cleaning station, centrifuge station, drill station, filling station and print test station;

(2) providing an operator for operating the inkjet cartridge refilling machine;

(3) receiving an inkjet cartridge to be refilled from a customer;

(4) having the operator initiate the software to process, refill and test the cartridge;

(5) having the operator receive a first instruction via the touch screen display requesting information to identify the type of cartridge to be refilled;

(6) having the operator enter information into the computer via the touch screen display about the type of cartridge to be refilled;

(7) upon identifying the type of cartridge to be refilled, having the operator receive a second instruction via the touch screen display about testing the cartridge for suitability for refilling;

(8) having the operator test the cartridge for suitability for refilling in accordance with the second instruction;

(9) having the operator receive a third instruction via the touch screen display about removing residual ink from the cartridge via a centrifuge in the centrifuge station;

(10) having the operator remove residual ink from the cartridge in accordance with the third instruction;

(11)(a) in the event that the ink tank contains a sponge, (i) having the operator receive a fourth instruction via the touch screen display about drilling one or more access holes in the tank portion of the cartridge, then (ii) having the operator drill one or more access holes into the tank portion of the cartridge in accordance with the fourth instruction;

(11)(b) in the event that the ink tank contains a bladder, having the operator receive a fourth instruction via the touch screen display to proceed to the cleaning step;

(12) having the operator receive a fifth instruction via the touch screen display about cleaning the printhead on the cartridge in the cleaning station;

(13) having the operator clean the printhead in accordance with the fifth instruction;

(14) having the operator receive a sixth instruction via the touch screen display about refilling the tank portion of the cartridge with replacement ink;

(15) having the operator refill the tank portion of the cartridge with replacement ink in accordance with the sixth instruction;

(16) having the operator receive a seventh instruction via the touch screen display about testing the refilled cartridge for print functionality;

(17) having the operator test the refilled cartridge for print functionality in accordance with the seventh instruction; and (18)(a) if the cartridge passes the test for print functionality, having the operator relabel the refilled cartridge, and return the relabeled cartridge to the customer; or (18)(b) if the cartridge does not pass the test for print functionality, having the operator dispose of the refilled cartridge.

15. The process of claim 14, wherein the cabinet structure further houses the circuit test station and the print test station.

16. The process of claim 14, wherein the step of having the operator test the cartridge for suitability for refilling comprises the steps of having the operator visually inspecting the cartridge for damage, and having the operator test electronic circuitry of the printhead with the circuit test station.

17. The process of claim 14, wherein the ink tank of the cartridge comprises a sponge, and wherein the step of having the operator refill the tank portion of the cartridge with replacement ink comprises the step of vacuum filling the cartridge through the one or more access holes in the vacuum filling device.

18. The process of claim 14, wherein the ink tank of the cartridge comprises a bladder, and wherein the step of having the operator refill the tank portion of the cartridge with replacement ink comprises the step of pressure filling the cartridge through the integrated printhead in the pressure filling device.

19. The process of claim 14, wherein the cabinet structure further houses a communication port for allowing remote access to the computer.

20. The process of claim 19, wherein the computer is programmed with software that collects information on at least the number and type of cartridges that have been refilled, and wherein the process further comprises the step of remotely accessing the computer via the communication port to obtain such collected information.

21. The process of claim 19, further comprising the step of remotely accessing the computer via the communication port to obtain diagnostic information on the machine.

22. The process of claim 14, wherein the step of having the operator test the cartridge for suitability for refilling comprises the steps of having the operator perform a visual inspection of the cartridge, and having the operator test the cartridge in the circuit test station.

23. The process of claim 14, conducted in a retail location.

* * * * *